United States Patent [19]

Bowden

[11] 4,427,935

[45] Jan. 24, 1984

[54] CONSTANT CURRENT SOURCE

[75] Inventor: Edgar A. Bowden, Arlington, Tex.

[73] Assignee: Mobil Oil Corporation, New York, N.Y.

[21] Appl. No.: 310,543

[22] Filed: Oct. 13, 1981

[51] Int. Cl.[3] ..... G05F 1/12

[52] U.S. Cl. ..... 323/280

[58] Field of Search ..... 307/362, 529; 323/268–270, 273, 275, 277, 280, 285, 297; 328/144, 160; 363/13, 39, 46, 74, 123

[56] References Cited

U.S. PATENT DOCUMENTS 3,370,222 2/1968 Haagen-Smit et al. ..... 323/280

4,348,632 9/1982 Galwey et al. ..... 323/280

*Primary Examiner*—A. D. Pellinen

*Attorney, Agent, or Firm*—Alexander J. McKillop; James F. Powers, Jr.; George W. Hager, Jr.

[57] ABSTRACT

A constant current source employs a correction signal which is multiplied with the output of the current source to correct for amplitude variations and thereby maintain a constant current output level.

3 Claims, 1 Drawing Figure

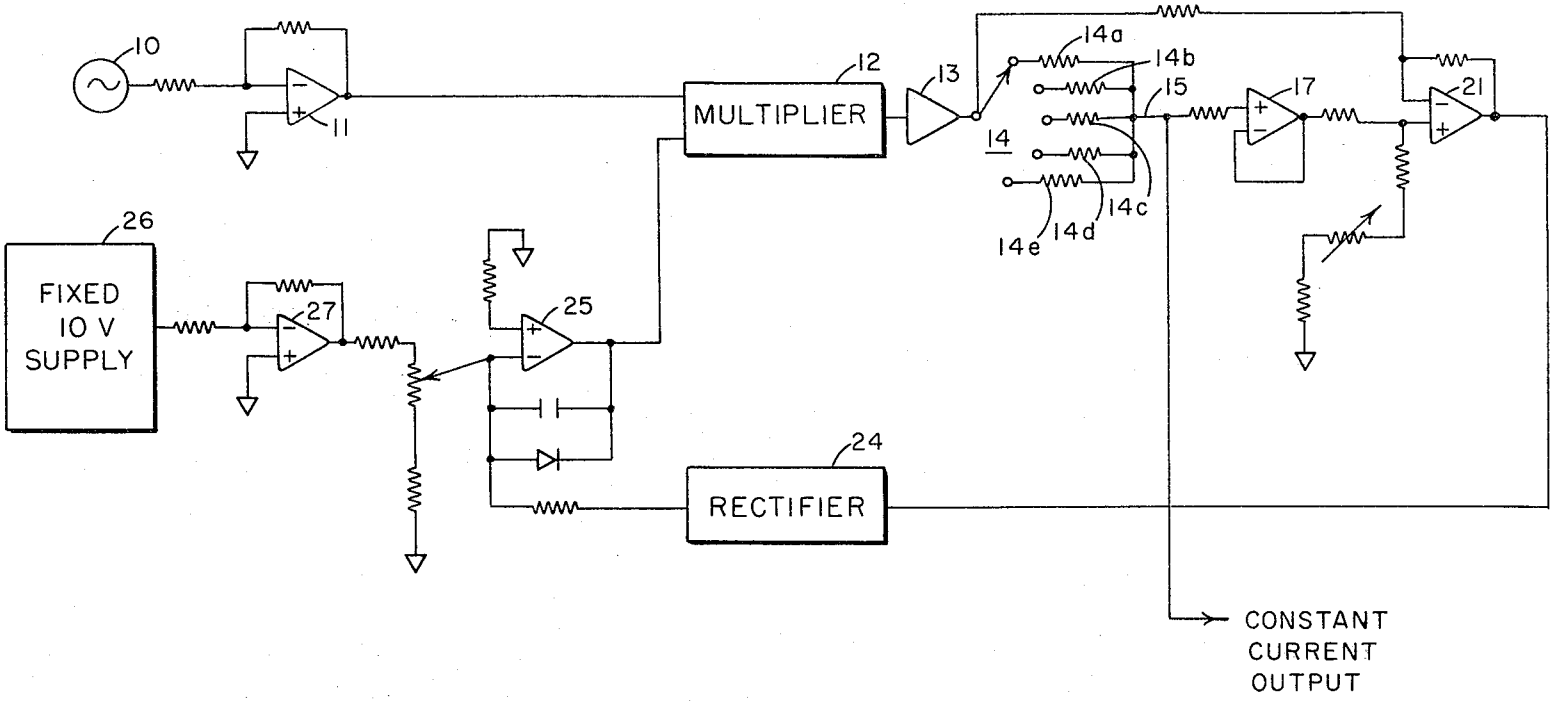
MULTIPLIER
RECTIFIER
FIXED 10 V SUPPLY
CONSTANT CURRENT OUTPUT
10
11
12
13
14
14a
14b
14c
14d
14e
15
17
21
24
25
26
27

CONSTANT CURRENT SOURCE

BACKGROUND OF THE INVENTION

Current sources are generally of the voltage-to-current type converters. In such converters the output current is directly proportional to the input voltage. Unless the input voltage is from a highly stable voltage source, the output current will be subject to the variations and fluctuations of the input voltage.

It is important in many operations, such as in resistivity measuring apparatus and systems, to have a source of current that exhibits a constant-current level free of any such variations and fluctuations. Accordingly, it is a specific feature of the present invention to provide for such a constant-current source.

SUMMARY OF THE INVENTION

The present invention is directed toward a current source for use whenever the current output needs to be maintained at a constant level. A current source is applied to a resistive element and a reference voltage is produced representative of the voltage differential across the resistive element. A fixed DC voltage is provided and the difference between this fixed DC voltage and the reference voltage is integrated to produce a correction signal. This correction signal, when multiplied with the output of the current source, corrects for amplitude variations in the current source. In this manner, the current through the resistive element is maintained at a constant level regardless of instability of the current source.

In a further aspect of the invention, the reference voltage is produced by measuring the voltage differential across the resistive element and rectifying such voltage differential measurement to remove any DC ripple present.

In a yet further aspect, the resistive element includes a bank of resistors and means for establishing the value of the constant-current flow by the selection of at least one of the resistors in the bank of resistors.

BRIEF DESCRIPTION OF THE DRAWING

The FIGURE is an electrical schematic of the constant-current source of the present invention.

DESCRIPTION OF THE PREFERRED EMBODIMENT

Referring to the FIGURE, a variable-frequency RMS current source 10 is connected through inverter 11 to one input of a multiplier 12. The other input to multiplier 12 is a correction signal supplied by the integrator 25. This correction signal, when multiplied with the output from the current source 10 corrects for amplitude instability of the oscillator of current source 10 and results in a constant-current output on line 15. This correction signal is derived in the following manner. The current output from multiplier 12 is applied through an amplifier 13 to a bank of resistors 14. These particular resistors are selected to vary the current line 15 in incremental steps from one micoampere to 10 milliamperes for example. The desired value of current then passes through the amplifier 17 to a differential amplifier 21 which operates to measure the voltage differential across the bank of resistors 14. This voltage differential is a D.C. voltage with a small amount of ripple which is removed through rectification in digital converter 24. This differential voltage is then applied as a reference voltage to the integrator 25. Also applied to integrator 25 through an inverter 27 is a fixed D.C. voltage from the supply 26. Integrator 25 operates to integrate the difference between the rectified reference voltage and the fixed D.C. voltage. The output of integrator 25 is utilized as the correction signal to multiplier 12 for correcting amplitude variations in the current output from oscillator 10. In this manner a constant-current output is maintained regardless of oscillatory instability of the current source itself.

Having described the constant-current source of the present invention in conjunction with the circuitry illustrated in the FIGURE, it is to be understood that such circuitry is merely representative of one embodiment. In accordance with such embodiment, the following sets forth specific types of circuit components.

| Reference Designation | Description |
|---|---|
| Oscillator 10 | DG 502 Tektronix |
| Inverters 11 & 27 | TL084 |
| Multiplier 12 | AD534 |
| Amplifier 13 | LH0002 |
| Resistor 14a | 1M |
| Resistor 14b | 100K |
| Resistor 14c | 10K |
| Resistor 14d | 1K |
| Resistor 14e | 100 |
| Amplifiers 17 & 21 | OP15 |
| A/D Converter 24 | AD442K |
| Integrator 25 | TL084 |
| 10 VDC Supply | MC1404A |

It is to be understood that the foregoing description relates to only a preferred embodiment of the invention and that modifications or alterations may be made without departing from the spirit and scope of the invention as set forth in the appended claims.

I claim:

1. A system for correcting for amplitude variation in current flow from an unstable oscillatory current source, comprising:

(a) a resistive element through which the current from said oscillatory current source is passed, (b) means for producing a reference voltage representative of the voltage differential across said resistive element, (c) a source of fixed D.C. voltage, (d) means for integrating the difference between said reference voltage and said fixed D.C. voltage to produce a correction signal representative of an amplitude variation in said current, (e) means for multiplying the current with said correction signal to correct for said amplitude variation in said oscillatory current source, whereby the current through said resistive element is maintained at a constant level regardless of amplitude instability of the said oscillatory current source.

2. The system of claim 1 wherein said means for producing said reference voltage includes, (a) means for measuring the voltage differential across said resistive element, and (b) means for rectifying said measured voltage differential to remove any DC ripple in said measured voltage differential.

3. A method for controlling amplitude instability in an oscillatory current source, comprising the steps of (a) applying an oscillatory current source to a resistive element, (b) producing a reference voltage representative of the amplitude of the oscillatory current through said resistive element, (c) rectifying said reference voltage, (d) comparing said rectified reference voltage with a fixed voltage, the difference between said reference and fixed voltages being integrated to represent any change in the amplitude of said current due to current source amplitude instability, and (d) multiplying said integrated difference between said fixed and reference voltages with the current from said oscillatory current source to correct said current for oscillatory amplitude instability.

* * * * *